US008481902B2

(12) United States Patent
Leboeuf et al.

(10) Patent No.: US 8,481,902 B2
(45) Date of Patent: Jul. 9, 2013

(54) HEATING ELEMENT PRODUCTION

(75) Inventors: Stéphane Leboeuf, Buchelay (FR); Laetitia Piguet, Beon (FR)

(73) Assignee: SEB SA, Ecully (FR)

( * ) Notice: Subject to any disclaimer, the term of this patent is extended or adjusted under 35 U.S.C. 154(b) by 1339 days.

(21) Appl. No.: 11/629,231

(22) PCT Filed: Jun. 3, 2005

(86) PCT No.: PCT/FR2005/001365

§ 371 (c)(1),
(2), (4) Date: May 14, 2008

(87) PCT Pub. No.: WO2006/003282

PCT Pub. Date: Jan. 12, 2006

(65) Prior Publication Data

US 2008/0290088 A1 Nov. 27, 2008

(30) Foreign Application Priority Data

Jun. 11, 2004 (FR) ..... 04 06380

(51) Int. Cl.
*H05B 3/02* (2006.01)

(52) U.S. Cl.
USPC ..... 219/764; 399/328; 425/549

(58) Field of Classification Search
USPC ..... 219/764, 482, 543, 217, 536; 375/316, 375/324, 345, 354; 327/333; 427/58; 392/459, 392/435, 441, 438; 425/549
See application file for complete search history.

(56) References Cited

U.S. PATENT DOCUMENTS

| | | | | |
|---|---|---|---|---|
| 3,013,897 | A | 12/1961 | Cupery et al. | |
| 3,108,170 | A | 10/1963 | Murphy | |
| 3,473,952 | A | 10/1969 | McFadden | |
| 3,534,148 | A | 10/1970 | Bange | |
| 3,663,793 | A | 5/1972 | Petro et al. | |
| 3,934,748 | A | 1/1976 | Racz | |
| 4,959,256 | A | 9/1990 | Piera | |
| 5,037,675 | A | 8/1991 | Kishi et al. | |
| 5,536,583 | A | 7/1996 | Roberts et al. | |
| 6,238,847 | B1 | 5/2001 | Axtell, III et al. | |
| 6,612,498 | B1 | 9/2003 | Lipponen et al. | |
| 7,241,131 | B1 * | 7/2007 | Booth et al. | 425/549 |

(Continued)

FOREIGN PATENT DOCUMENTS

| | | |
|---|---|---|
| DE | 7200907 | 8/1972 |
| DE | 2827461 | 1/1980 |

(Continued)

OTHER PUBLICATIONS

French Search Report for FR0403291 dated Nov. 5, 2004.

(Continued)

*Primary Examiner* — Quang Van
(74) *Attorney, Agent, or Firm* — Patterson Thuente Pedersen, P.A.

(57) ABSTRACT

This invention is to eliminate all of the above-mentioned disadvantages by proposing a heating element intended to be deposited on a metal substrate, e.g., made of aluminium or an aluminium alloy, or even stainless steel, which is capable of delivering high outputs, in particular with a surface/output ratio possibly going as high as values on the order of 40 W/cm$^2$, while at the same time maintaining good dielectric performance levels and/or being capable of delivering an even degree of heat over an entire surface.

14 Claims, 1 Drawing Sheet

U.S. PATENT DOCUMENTS

| | | | | |
|---|---|---|---|---|
| 8,227,072 | B2 | 7/2012 | Le Bris et al. | |
| 2002/0179329 | A1* | 12/2002 | Fukuoka et al. | 174/260 |
| 2003/0059600 | A1 | 3/2003 | Gazo et al. | |
| 2003/0138661 | A1 | 7/2003 | Souchard et al. | |
| 2005/0036809 | A1* | 2/2005 | Fukita et al. | 399/328 |
| 2008/0237241 | A1 | 10/2008 | Buffard et al. | |
| 2009/0004434 | A1 | 1/2009 | Parent et al. | |
| 2009/0099287 | A1 | 4/2009 | Gier et al. | |
| 2010/0003537 | A1 | 1/2010 | Akarsu et al. | |
| 2011/0174826 | A1 | 7/2011 | Le Bris et al. | |
| 2011/0180546 | A1 | 7/2011 | Le Bris et al. | |
| 2011/0192850 | A1 | 8/2011 | Le Bris et al. | |
| 2011/0198358 | A1 | 8/2011 | Parent et al. | |
| 2011/0308989 | A1 | 12/2011 | Berrux et al. | |
| 2012/0018433 | A1 | 1/2012 | Le Bris et al. | |

FOREIGN PATENT DOCUMENTS

| | | |
|---|---|---|
| DE | 10059487 | 6/2002 |
| DE | 203 19 024 | 3/2004 |
| EP | 0285161 | 10/1988 |
| EP | 0323349 | 7/1989 |
| EP | 0515705 | 12/1992 |
| EP | 0580557 | 1/1994 |
| EP | 1835002 | 9/2007 |
| FR | 1536889 | 8/1968 |
| FR | 2 275 103 | 1/1976 |
| FR | 2576038 | 7/1986 |
| FR | 2622600 | 5/1989 |
| FR | 2625494 | 7/1989 |
| FR | 2882240 | 8/2006 |
| GB | 926001 | 5/1963 |
| GB | 926002 | 5/1963 |
| GB | 1159390 | 7/1969 |
| GB | 2169282 | 7/1986 |
| JP | 2-279574 | 11/1990 |
| WO | WO99/16625 | 4/1999 |
| WO | WO00/22395 | 4/2000 |
| WO | WO00/56537 | 9/2000 |
| WO | WO 2004-049761 | 6/2004 |

OTHER PUBLICATIONS

International Search Report and Written Opinion for PCT/FR2005/000775 dated Aug. 12, 2005.

International Search Report for International Application No. PCT/FR2006/002313 dated Feb. 8, 2007.

International Search Report for International Application No. PCT/IB2009/007973 dated Sep. 9, 2010.

Randau et al., "Enamels and Enamelling", 1900. Scott Greenwood and Company. pp. 142-144.

Application and File History for U.S. Appl. No. 10/594,378, filed Jan. 29, 2008, inventors Buffard et al.

Application and File History for U.S. Appl. No. 13/142,137, filed Sep. 9, 2011, inventors Berrux et al.

Application and File History of U.S Appl. No. 12/997,569, filed Apr. 11, 2011, inventors Le Bris et al.

Application and File History of U.S. Appl. No. 12/163,289, filed Jun. 27, 2008, inventors Parent et al.

Application and File History of U.S. Appl. No. 12/997,574, filed Apr. 4, 2011, inventors Parent et al.

Application and File History of U.S. Appl. No. 13/000,888, filed Apr. 4, 2011, inventors Le Bris et al.

Application and File History of U.S. Appl. No. 13/000,906, filed Apr. 25, 2011, inventors Le Bris et al.

* cited by examiner

HEATING ELEMENT PRODUCTION

RELATED APPLICATIONS

This application claims priority to PCT Application No. PCT/FR2005/001365 filed Jun. 3, 2005, and French Application No. 0406380 filed Jun. 11, 2004, the disclosures of which are hereby incorporated by reference in their entireties.

TECHNICAL FIELD

This invention relates to a heating element intended to be placed on a metal substrate, e.g., made of aluminium or an aluminium alloy, as well as the method of production thereof. The invention also relates to an article equipped with such a heating element as well as the method for producing such an article. In particular, the heating element according to the invention cooking utensils or culinary articles, iron soleplates, hot pot bases, etc.

BACKGROUND OF THE INVENTION

In the area of high output, so-called "thick film" heating elements are known, which have a very high degree of uniformity and an optimal surface/output ratio.

Such heating elements consist of enamels that are obtained from an enamel frit subjected to a curing temperature of the order of 850° C. Considering this production constraint, they are deposited on a metal substrate capable of withstanding such temperatures, e.g., of the steel, stainless steel or even alumina type. Such enamels, however, are not suitable for being deposited on an aluminium substrate.

Enamels exist that require curing temperatures lower than that indicated above and that are therefore capable of being deposited on an aluminium substrate. To do so, fluxing agents such as lead are added to the above-mentioned enamel frits. However, it is observed that the dielectric performance of heating elements obtained in this way is not at all satisfactory, as the fluxing agents render the enamel electrically conductive.

SUMMARY OF THE INVENTION

It would be desirable for a heating element to be able to deliver high output, with an output/surface ratio of at least 1 W/cm$^2$ and possibly going as high as values of the order of 40 W/cm$^2$. It would be desirable for this type of heating element to enable the distribution of heat evenly over an entire surface and to do so whether the output is high or low.

Therefore, the purpose of this invention is to eliminate all of the above-mentioned disadvantages by proposing a heating element intended to be deposited on a metal substrate, e.g., made of aluminium or an aluminium alloy, or even stainless steel, which is capable of delivering high outputs, in particular with a surface/output ratio possibly going as high as values on the order of 40 W/cm$^2$, while at the same time maintaining good dielectric performance levels and/or being capable of delivering an even degree of heat over an entire surface.

Furthermore, the heating element must have a simple structure and a very high degree of uniformity.

Thus, the object of this invention is a heating element intended to be deposited on a metal substrate, preferably made of aluminium or an aluminium alloy.

According to the invention, this element includes, starting from the substrate, at least one dielectric layer containing a resin and dielectric fillers, at least one resistive layer containing a resin and electrically conductive fillers, at least one conductive layer, which is intended for the electrical connection of said resistive layer and which contains a resin and electrically conductive fillers, and at least one final protective layer containing resin and dielectric fillers, said dielectric, resistive, conductive and final protective layers containing the same resin, said resin being an organic resin.

Thus, the heating element according to the invention is produced by layering, each layer having a composition specifically suited to the desired function for said layer.

The use of an organic resin for each of the dielectric, resistive, conductive and final protective layers makes it possible to obtain a very high degree of uniformity within each of said layers, with no observable migration phenomenon of the fillers, whether dielectric or else electrically conductive fillers are involved.

The use of the same resin in all of the dielectric, resistive, conductive and final protective layers further makes it possible to obtain an excellent degree of adhesion and cohesion between said layers and to prevent any delamination phenomenon of one layer in relation to another.

The choice of the resin is determined by the manufacturing conditions of the heating element and the final use thereof.

Preferably, an exclusively organic resin will be chosen, which is resistant to high temperatures, e.g., of at least 200-250° C., under operating conditions for the heating element.

According to a particularly preferred embodiment of the invention, the resin present in the dielectric, resistive, conductive and final protective layers contains at least one compound chosen from a polyamide-imide (PAI), a polyimide (PI), a polyethersulfone (PES), a polyetherimide (PEI), a poly(phenylene sulphide) (PPS), a silicone and an epoxy resin.

Another purpose of this invention consists in proposing a method for producing such heating elements on a metal substrate, made in particular of aluminium or an aluminium alloy, said method being easy to produce commercially and making it possible to produce heating elements in large numbers and at a low cost.

According to the invention, this method includes the following steps:

- application onto the substrate of at least one dielectric layer consisting of resin and dielectric fillers,
- application onto the dielectric layer last deposited in the previous step, of at least one resistive layer consisting of resin and electrically conductive fillers,
- application onto the last resistive layer deposited in the previous step, of at least one conductive layer containing resin and electrically conductive fillers, and then
- application, over the entire surface, except that of the last conductive layer deposited in the previous step, of at least one final protective layer consisting of resin and dielectric fillers,
- curing of said dielectric, resistive, conductive and final protective layers,
- each of said dielectric, resistive, conductive and final protective layers containing the same resin, said resin being an organic resin.

The use of one and the same organic resin makes it possible to only anticipate a single curing step.

In one particularly advantageous version of the invention, the application of each of the dielectric, resistive, conductive and final protective layers is carried out by means of screen printing.

Application by means of screen printing makes it possible to produce layers having a constant and controlled thickness, in the most economical way possible.

It is therefore possible to obtain thin heating elements, thereby enabling space to be saved within the structure that the heating element is intended to equip.

In fact, this invention also relates to an article provided with a heating element according to the invention that is deposited on a metal substrate made in particular of aluminium or an aluminium alloy.

It was observed that the heating element according to the invention surprisingly had a certain degree of flexibility enabling it to remain operational when the metal substrate on which the heating element is deposited came under stress.

In particular, the invention concerns a culinary article or utensil comprising a heating element according to the invention and, on the face of the substrate not comprising said heating element, an enamel coating or a non-stick coating, in particular fluorocarbon resin-based, e.g., PTFE-based.

Finally, the invention relates to a method for producing such an article, particularly a culinary article, including a first step for depositing an enamel or non-stick coating, in particular fluorocarbon resin-based, e.g., PTFE-based, onto one of the mutually opposing faces of a metal substrate made in particular of aluminium or an aluminium alloy, and a second step for depositing onto the other face of the substrate a heating element manufactured according to the method of this invention.

Thus, owing to this invention, it is entirely possible to produce a heating element on a face of a substrate without altering the enamel or non-stick coating previously deposited on the other face of said substrate.

This presents a real advantage in the field of culinary articles where the use of electrically heating non-stick surfaces is widespread.

BRIEF DESCRIPTION OF THE DRAWINGS

Other advantages and characteristics of this invention will be derived from the following description made in reference to the appended figures.

DETAILED DESCRIPTION OF THE DRAWINGS

Figure 1:
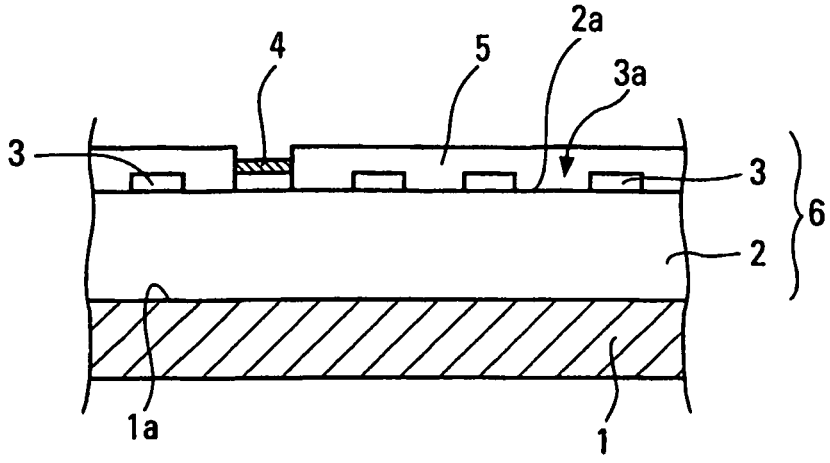
FIG. 1 shows a cross-sectional schematic view of the structure of a heating element according to the invention deposited on a substrate.
Figure 2:
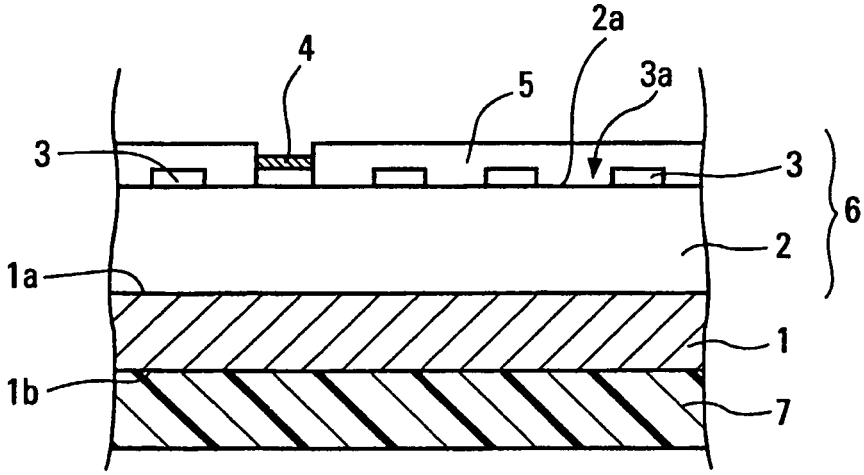
FIG. 2 shows the heating element of FIG. 1 deposited on the substrate, which is itself covered with a coating, e.g., a non-stick coating.

The elements common to FIGS. 1 and 2 are identified by the same numerical references.

In FIG. 1, a substrate 1 made of aluminium or an aluminium alloy has been shown. It is likewise possible to anticipate a substrate 1 formed from a metal plate, e.g., made of steel or stainless steel, said plate being coated with aluminium.

The substrate 1 is commonly a disk but, of course, any other shape may be anticipated.

The face 1 of the substrate 1 is coated with at least one continuous dielectric layer 2 and consists of resin and dielectric fillers.

The dielectric layer 2 is coated with a resistive layer 3 consisting of resin and electrically conductive fillers.

The resistive layer 3 is preferably in the form of a track whose dimensions such as length and thickness may quite obviously be customized to the desired resistance.

The track forming the resistive layer 3, for example, may be in the form of a spiral of which only the cross-sections of each convolution are shown in FIGS. 1 and 2.

At least one conductive layer 4 consisting of resin and electrically conductive fillers is deposited on the resistive layer 3.

This conductive layer 4, which covers only a small portion of the resistive layer 3, is intended for the electrical connection of the resistive layer 3.

At least one final protective layer 5, consisting of resin and dielectric fillers, is deposited over the entire surface except for the conductive layer 4.

As shown in FIG. 1, this final protective layer 5 thus covers the resistive layer 3 as well as certain regions 2*a* of the dielectric layer 2, said regions 2*a* being situated at the location of the gaps 3*a* left open by the resistive layer 3, when the latter is in the form of a track.

The heating element 6 consists of the assembly formed by the dielectric 2, resistive 3, conductive 4 and final protective 5 layers.

The dielectric 2, resistive 3, conductive 4 and final protective 5 layers contain the same organic resin.

This resin preferably contains at least one compound chosen from a polyamide-imide (PAI), a polyimide (PI), a polyethersulfone (PES), a polyetherimide (PEI), a poly(phenylene sulphide) (PPS), a silicone and an epoxy resin.

The dielectric fillers of each dielectric layer 2 may contain at least one element chosen from among mica, alumina, silica, clay, quartz, talc, glass or boron nitride.

The grain size of the dielectric fillers is a determining factor, in particular in the case where each dielectric layer 2 is applied by means of screen printing, so as not to plug the mesh of the silkscreen.

In one advantageous version of the invention, the average size of the dielectric fillers is less than 25 μm, and preferably less than 10 μm.

The proportion by weight of the dielectric fillers contained in each dielectric layer 2 is preferably adjusted in order to obtain electrical isolation between the resistive layer 3 and the substrate 1, when a potential difference of at least 1250 V is applied between said resistive layer 3 and the substrate 1 for at least one minute.

In one advantageous version of the invention each dielectric layer 2 contains from 30 to 70% by weight, and preferably from 40 to 50% by weight of dielectric fillers, and from 30 to 70% by weight, and preferably from 50 to 60% by weight of pure resin or resin in solution, said solution containing at least 10% by weight of pure resin.

Such weight proportions make it possible to obtain a composition that is sufficiently fluid to anticipate the application of each dielectric layer 2 by means of screen printing. Furthermore, it may be anticipated that each dielectric layer 2 will retain a certain degree of flexibility after curing, enabling it to resist external stresses that may be exerted during final production of the article.

The electrically conductive fillers contained in the composition of each resistive layer 3, but also of each conductive layer 4, contain at least one element chosen from among inorganic, metal, ceramic or composite particles equipped with electrical conduction properties.

Thus, as electrically conductive fillers, it is possible to choose particles of silver, copper, graphite, carbon, nickel, palladium, nitrides or carbides, and in particular nitrides and carbides of zirconium, hafnium or titanium.

Among the composite particles, coated particles in particular may be cited, such as glass particles coated with metal, e.g., coated with silver.

As was seen previously in the case of the dielectric fillers, the grain size of the electrically conductive fillers is adapted to the anticipated method of application for applying each resistive layer 3 and each conductive layer 4.

The average size of the electrically conductive fillets of each resistive layer 3 and of each conductive layer 4 is preferably less than 20 μm, preferably ranging between 1 and 5 μm.

The thickness of each resistive layer 3 and the weight proportion of electrically conductive fillers contained in this resistive layer 3 are preferably adapted to provide a resistance of 5 to 1000Ω, with respect to the width and length of the resistive track thus formed in this resistive layer 3.

According to one advantageous version of the invention, each resistive layer 3 contains from 50 to 85% by weight, and preferably from 60 to 70% by weight of electrically conductive fillers, and from 15 to 50% by weight, and preferentially from 30 to 40% by weight of pure resin or resin in solution, said solution containing at least 10% by weight of pure resin.

Each conductive layer 4 comprises a weight proportion of electrically conductive fillers of at least 70%, the weight ratio of electrically conductive fillers to pure resin being greater than or equal to 9.

In one advantageous version of the invention, the final protective layer 5 has the same composition as the dielectric layer 2.

It is easily understood that, after curing the assembly of dielectric 2, resistive 3, conductive 4 and final protective 5 layers, a heating element 6 is obtained that has an excellent degree of uniformity, the presence of the same resin in all of these layers 2, 3, 4 and 5 creating a sort of uniform matrix. In other words, this same resin is added to very specific areas or locations forming the layers and/or areas suited to the desired functions as indicated previously (resistance, connection or isolation).

Owing to the presence of the same organic resin in the layers 2, 3, 4 and 5, the heating element 6 has a certain degree of flexibility. This could not be obtained with the heating elements of the prior art, which consist of enamels, the latter breaking under the effects of even a slight amount of stress.

For example, when the assembly consisting of the substrate 1 and the heating element 6 is subjected to stress, no rupture of the heating element 6 is observed up to a bending radius of the order of 210 mm for an aluminium substrate 1 approximately 2 mm thick and a heating element 6 with a thickness of approximately 500 μm.

It is quite obvious that, based on the parameters (materials, thickness, etc.) used for the substrate 1 and the heating element 6, it is possible to obtain bending radius values lower than that indicated in the preceding paragraph and, as a result, larger bends in the assembly consisting of the substrate 1 and the heating element 6, said heating element 6 not being damaged under the effect of stress.

Thus, this flexibility makes it possible to produce articles, and particularly convex culinary articles, from the assembly consisting of the substrate 1 and the heating element 6.

The method for producing the heating element 6 includes the following steps:

at least one dielectric layer 2 consisting of resin and dielectric fillers is applied to the metal substrate, such as one made of aluminium or an aluminium alloy, at least one resistive layer 3 consisting of resin and electrically conductive fillers is applied, this resistive layer 3 being applied to the at least one dielectric layer 2 deposited in the previous step, either to the dielectric layer 2 as in the embodiment shown in FIGS. 1 and 2, or to at least one of the dielectric layers 2, it being specified that the last dielectric layer 2 applied is necessarily coated with at least one resistive layer 3, at least conductive layer 4 consisting of resin and electrically conductive fillers is applied to the last resistive layer 3 deposited in the previous step, then at least one final protective layer 5 consisting of resin and dielectric fillers is applied to the entire surface, except for the surface of the last conductive layer 4 deposited in the previous step.

It is quite obviously possible to carry out a step involving mechanical or chemical pre-treatment of the face 1*a* of the substrate 1, in order to enable optimised adhesion of the first dielectric layer 2 to the substrate 1.

The application of each of the dielectric 2, resistive 3, conductive 4 and final protective 5 layers is preferably carried out by means of screen printing, thereby enabling excellent control of the thickness of each of the layers 2, 3, 4 and 5.

An ordinary drying operation is then carried out on each layer deposited prior to application of the next one, in order to eliminate the volatile compounds and enable application of the silkscreen, without any risk of damaging the layer deposited last.

After all of the layers 2, 3, 4 and 5 have been applied, a single curing step is carried out in order to ensure polymerisation of the resin contained in the composition of said layers 2, 3, 4, 5. Owing to this single curing step, a savings is obtained in terms of energy, materials handling or even space.

In one advantageous version of the invention, the thickness of all of the dielectric layers 2 ranges between 30 and 300 μm and, preferably, between 90 and 150 μm.

The thickness of all of the resistive layers 3 ranges between 5 and 50 μm, that of all of the conductive layers 4 ranges between 10 and 30 μm and that of all of the final protective layers 5 ranges between 15 and 35 μm.

As an alternative to the embodiment of the heating element 6 shown in FIGS. 1 and 2 comprising a dielectric layer 2, a resistive layer 3, a dielectric layer 4 and a final protective layer 5, it is entirely possible to produce a heating element requiring the application of two, three, or even more of any of the dielectric 2, resistive 3, conductive 4 and final protective 5 layers, in order to obtain the above-mentioned thicknesses.

This alternative is more particularly applicable for producing the dielectric layer 2. In fact, several dielectric layers 2 are superimposed in order to attain the thickness indicated above for all of the dielectric layers 2.

In FIG. 2, the heating element 6 has been shown, deposited on the face 1*a* of the substrate 1 shown in FIG. 1.

The face 1*b* of the substrate 1 is itself coated with a coating 7. This coating 7 can be made of enamel or be non-stick, the latter possibly being fluorocarbon resin-based, e.g., PTFE-based.

It is possible to anticipate multiple applications implementing the heating element 6 according to the invention.

As a non-limiting example, culinary articles, hot pots and irons may be cited.

The invention claimed is:

1. A heating element for a metal substrate of a culinary article or utensil, the heating element comprising:

at least one dielectric layer, comprising a resin and dielectric fillers, in contact with the metal substrate;

at least one resistive layer, comprising a resin and electrically conductive fillers, in contact with the at least one dielectric layer;

at least one conductive layer, comprising a resin and electrically conductive fillers, in contact with the at least one resistive layer and adapted for the electrical connection of the at least one resistive layer; and at least one final protective layer, comprising resin and dielectric fillers, in contact with the at least one conductive layer, wherein the dielectric, resistive, conductive and final protective layers contain the same resin, the resin being an organic resin.

2. A heating element according to claim 1, wherein the resin comprises at least one compound selected from the group consisting of a polyamide-imide (PAI), a polyimide (PI), a polyethersulfone (PES), a polyetherimide (PEI), a poly(phenylene sulphide) (PPS), a silicone and an epoxy resin.

3. A heating element according to claim 1, wherein the proportion by weight of the dielectric fillers contained in each dielectric layer is adjusted in order to obtain electrical isolation between the resistive layer and the metal substrate, when a potential difference of at least 1250V is applied between the resistive layer and the metal substrate for at least one minute.

4. A heating element according to claim 3, wherein each dielectric layer comprises from 30 to 70% by weight of dielectric fillers, and from 30 to 70% by weight of pure resin or resin in solution, the solution containing at least 10% by weight of pure resin.

5. A heating element according to claim 1, wherein the average size of the dielectric fillers is less than 25 μm.

6. A heating element according to claim 1, wherein the dielectric fillers of each dielectric layer comprise at least one dielectric filler selected from the group consisting of mica, alumina, silica, clay, quartz, talc, glass or boron nitride.

7. A heating element according to claim 1, wherein the thickness of each resistive layer and the weight proportion of electrically conductive fillers contained in each resistive layer are adapted to provide a resistance of 5 to 1000Ω.

8. A heating element according to claim 7, wherein each resistive layer consists essentially of electrically conductive fillers in amount of 50 to 85% by weight, and a resin ingredient in amount of 15 to 50% by weight, the resin ingredient comprising at least 10% by weight of pure resin.

9. A heating element according to claim 1, wherein each conductive layer comprises electrically conductive fillers in a weight proportion of at least 70% by weight, the weight ratio of electrically conductive fillers to pure resin being greater than or equal to 9.

10. A heating element according to claim 1, wherein the average size of the electrically conductive fillers of each resistive layer and of each conductive layer is less than 20 μm.

11. A heating element according to claim 1, wherein the electrically conductive fillers of each resistive layer and of each conductive layer comprise particles selected from the group consisting of inorganic, metal, ceramic and composite particles and wherein the particles comprise an electrically conductive material selected from the group consisting of silver, copper, graphite, carbon, nickel, palladium, zirconium, hafnium and titanium.

12. A heating element according to claim 1, wherein the final protective layer has the same composition as the at least one dielectric layer.

13. A culinary article, comprising a metal substrate, the metal substrate having a first face and a second face; and a heating element according to claim 1 deposited on the first face of the metal substrate.

14. A culinary article according to claim 13, wherein the second face comprises a coating selected from the group consisting of enamel, PTFE-based coating, non-PTFE fluorocarbon non-stick coating, and non-fluorocarbon non-stick coating.

* * * * *